US005215474A

United States Patent [19]

Rotella

[11] Patent Number: 5,215,474

[45] Date of Patent: Jun. 1, 1993

[54] CONDUCTIVE CONNECTOR PIN PROTECTOR HAVING THE CAPABILITY TO PREVENT ELECTROSTATIC DISCHARGE DAMAGE TO AN ELECTRONIC ASSEMBLY

[75] Inventor: Vincent F. Rotella, Avenel, N.J.

[73] Assignee: Allied-Signal Inc., Morris Township, Morris County, N.J.

[21] Appl. No.: 771,679

[22] Filed: Oct. 4, 1991

[51] Int. Cl.[5] ..... H01R 13/44

[52] U.S. Cl. ..... 439/149; 361/220; 439/507; 439/509; 439/892

[58] Field of Search ..... 439/89, 149, 186, 367, 439/507, 509-511, 892; 361/212, 220

[56] References Cited

U.S. PATENT DOCUMENTS

| | | | |
|---|---|---|---|
| 3,648,108 | 3/1972 | Bailey | 439/507 |
| 3,653,498 | 4/1972 | Kisor | 439/507 |
| 3,784,957 | 1/1974 | Bailey | 439/149 |
| 4,146,291 | 3/1979 | Goff et al. | 439/181 |
| 4,427,114 | 1/1984 | Howell et al. | 361/220 |
| 4,591,221 | 5/1986 | DeBrouckere et al. | 439/509 |
| 4,740,169 | 4/1988 | Gordon | 439/149 |
| 5,026,295 | 6/1991 | Fong et al. | 439/149 |

*Primary Examiner*—Paula A. Bradley
*Attorney, Agent, or Firm*—Donald B. Paschburg; Howard G. Massung

[57] ABSTRACT

A connector pin protector manufactured of a flexible material is molded to capture pins of a connector mounted on an electronic assembly. The connector pin protector helps prevent physical damage and contamination to the pins. Also, the material of the connector pin protector is electrically conductive and is therefore capable of maintaining all input pins and output pins of the connector at the same voltage potential therefore reducing the possibility of electrostatic discharge damage through the connector to components of the electronic assembly.

3 Claims, 2 Drawing Sheets

CONDUCTIVE CONNECTOR PIN PROTECTOR HAVING THE CAPABILITY TO PREVENT ELECTROSTATIC DISCHARGE DAMAGE TO AN ELECTRONIC ASSEMBLY

BACKGROUND OF THE INVENTION

1. Field of the Invention

The present invention relates to protecting connectors and more particularly to preventing electrical damage as well as physical damage to pins of connectors.

2. Description of the Prior Art

There are a variety of products which offer connectors either protection from physical damage or protection from electrical damage. Texas Instruments manufactures a product (TI P/N Z685) which provides excellent physical protection, however it is fabricated from rubber which is a producer of electrostatic charge and therefore not recommended for use with sensitive components.

The connector industry also utilizes U-channel shunts commonly used to short input pins and output pins together, however these products do not provide adequate protection from physical damage and contamination. Furthermore, electrical protection is limited to connectors with two rows of pins only.

Another type of connector protector used in the industry is basically a shell which fits over the pins of the connector. The connector protector is held in place using polyimide tape. This device however does not provide electrostatic discharge protection since the pins of the connector are not shorted to each other. Furthermore, application and removal of the polyimide tape produces electrostatic discharge which is detrimental to the reliability of sensitive components. Application of the tape also adds an additional labor step and hence more cost.

Clearly there exist a need for a device that can more reliably guard against electrostatic discharge damage while simultaneously protecting pins against damage and contamination. Another important feature of the connector pin protector is the ease of installation and removal.

The choice of material of such a device is critical. The material's requirements include electrical conductivity, flexibility, and the ability to accurately mold the material into the proper shape.

SUMMARY OF THE INVENTION

The connector protector of the present invention is comprised of a flexible material which is molded to capture male pins of an electrical connector mounted on a circuit card, thus preventing physical damage and contamination to those pins during handling and storage. More importantly, the material is electrically conductive and will maintain all input pins and output pins at approximately the same voltage potential thus preventing electrostatic discharge damage through the connector to components on the circuit card.

DETAILED DESCRIPTION OF THE INVENTION

Many electronic assemblies contain components which are highly sensitive to electrostatic discharge. Electrostatic discharge can reduce equipment reliability or cause immediate failure of electronic components and assemblies. Electrostatic discharge can be generated by normal physical actions of personnel, relative motion or separation of two materials or by the flow of liquids, vapors or gases.

The connector pin protector of the present invention can be utilized to physically protect and electrically shunt male pins of connectors used on electronic assemblies. Physical and electrical protection is required during normal handling, processing and storage of electronic assemblies. Various embodiment of the present invention can be molded to accommodate a variety of connector sizes and pin geometries.

An advantage of the present invention is that it maintains all input pins and output pins of an electronic assembly at the same voltage potential. This is achieved since all pins of the I/O connector are electrically in contact with each other due to the conductive nature of the material utilized to manufacture the connector pin protector of the present invention. Hence the risk of developing a current which may damage sensitive components thru an I/O connector is greatly reduced.

In addition to the electrical protection provided by the present invention, the connector pin protector also protects the connector pins from contamination or damage which may occur during handling, processing and storage of the electronic assembly.

Figure 1:
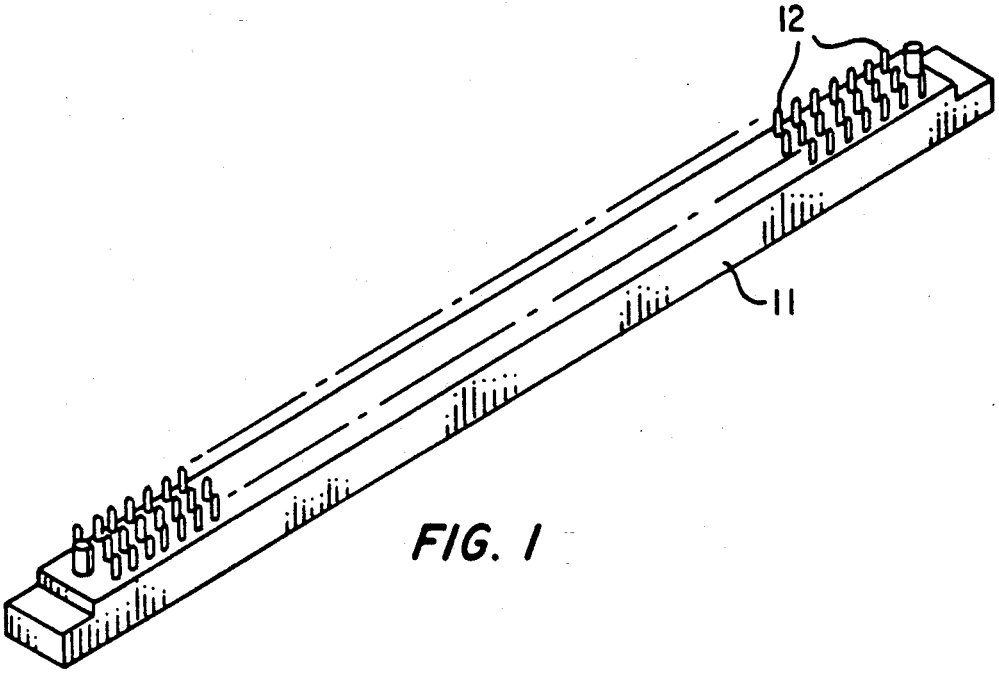
FIG. 1 illustrates an isometric view of a standard connector.

FIG. 1 illustrates a standard three row rectangular connector 11 that is used on a variety of types of electronic assemblies. Connector 11 comprises many pins 12 which, as can be seen from the drawing, are susceptible to contamination or damage.

Figure 2:
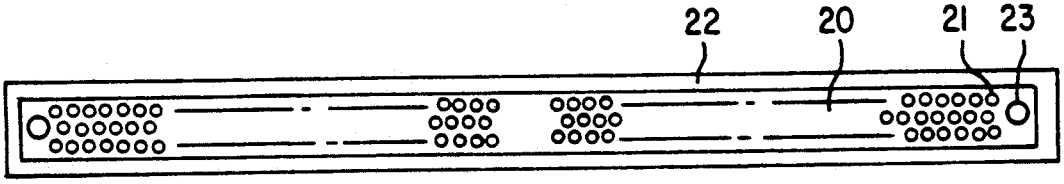
FIG. 2 illustrates a top view of one embodiment of the present invention.
Figure 3:
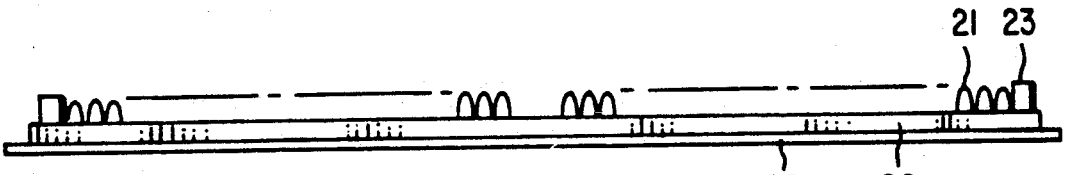
FIG. 3 illustrates a front view of one embodiment of the present invention.

FIGS. 2 and 3 illustrate a top view and a front view of one embodiment of connector pin protector 20. A typical embodiment of connector pin protector 20 utilizes 0.035" thick conductive velostat (3M Corp.). The velostat is molded such that it conforms to the shape of the connector and the connector's pin geometry. The figures depict the invention in a size that would accommodate a three row, 160 pin rectangular connector. However, other embodiments of the present invention can be molded to accommodate circular connectors, rectangular connectors of various lengths, connectors with more or less than three rows of pins, etc.

The size of dimples 21 with respect to the size of pins 12 of FIG. 1 is such that "wiping action" or slight friction maintains the connector pin protector in place. As stated above, the connector pin protector is molded to conform to the shape of the connector, therefore slight friction between the flanged perimeter 22 of the connector pin protector and the connector also help to maintain the connector pin protector in place. Holes 23 allow space for connector mating hardware. Since, the material of the connector pin protector is thin enough to maintain flexibility, installation and removal of the connector pin protector is easily performed. The present invention is reusable, that is, it does not readily yield to a permanent deformation.

The "wiping action" between the pins of the connector and the dimples of the connector pin protector occurs on each and every pin such that all of the pins of the connector are shorted together electrically and held at an equivalent potential. In a preferred embodiment, the surface resistivity of the velostat material is $3\times10^3$ ohms per square cm. and its volume resistivity is $32\times10^3$ ohm-cm. These characteristics provide sufficient electrical conduction for the present application. With all input pins and output pins on an electronic assembly held at the same potential, the risk of developing an electrical current that may damage sensitive components is greatly reduced. Note that these damaging electrical currents can be developed simply through normal processing, handling and storage of the electronic assembly.

The flanged perimeter 22 of the pin protector is designed to maintain the cleanliness of the connector contacts. This is important since residue on electrical connections can reduce performance. The design of the connector pin protector also prevents physical damage to the contacts since each pin in the array is individually protected.

Figure 4:
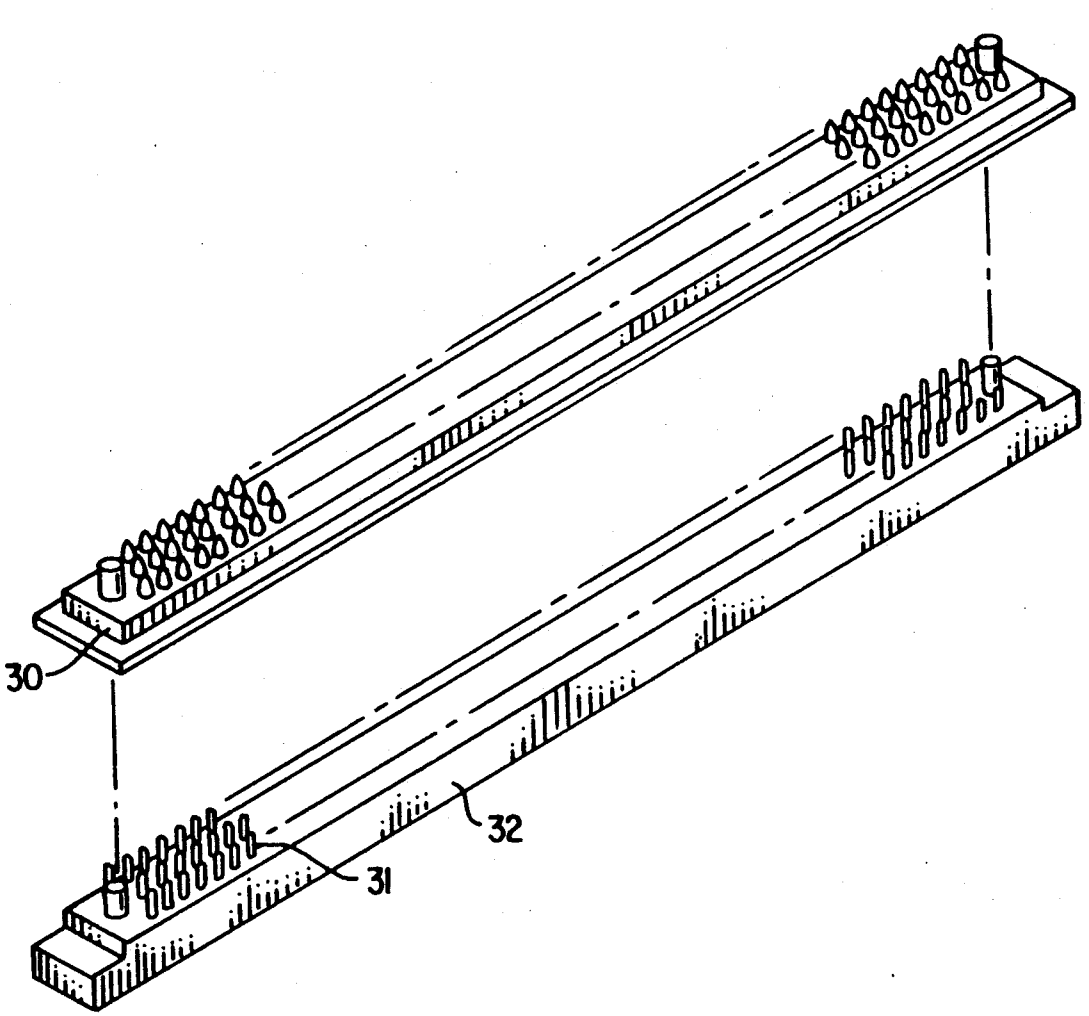
FIG. 4 illustrates an isometric view of one embodiment of the present invention lined up with a standard connector.

FIG. 4 illustrates an exploded isometric view of one embodiment of the present invention installed on a standard connector. As shown in FIG. 4 connector pin protector 30 is molded to capture pins 31 of electrical connector 32. As stated above, connector pin protector 30 provides physical protection as well as electrostatic discharge protection to the pins 31 of connector 32.

It is not intended that this invention be limited to the hardware arrangement, or operational procedures shown disclosed. This invention includes all of the alterations and variations thereto as encompassed within the scope of the claims as follows.

I claim:

1. A conductive connector pin protector comprising:

a member disposed over a connector and conforming to the shape of the connector and to the geometry of a plurality of connector input and output pins;

said member including a corresponding plurality of dimples, each of which captures a corresponding connector pin for physically protecting the captured pin, with the size of the dimples relative to the pins being such that friction occurs between the pins and the dimples whereby said member is maintained in place on the connector; and said member being of an electrically conductive material, with the electrically conductive material and the friction between the dimples and the pins being cooperatively effective for maintaining the pins at substantially the same voltage potential for preventing electrostatic discharge damage through said connector to components of an associated electrical assembly, wherein said member includes:

a flanged perimeter that fits around a base of said connector.

2. A conductive connector pin protector as claimed in claim 1, wherein:

friction between said flanged perimeter that fits around said base of said connector helps to maintain said conductive connector pin protector in place on said connector.

3. A conductive connector pin protector comprising:

a member disposed over a connector and conforming to the shape of the connector and to the geometry of a plurality of connector input and output pins;

said member including a corresponding plurality of dimples, each of which captures a corresponding connector pin for physically protecting the captured pin, with the size of the dimples relative to the pins being such that friction occurs between the pins and the dimples whereby said member is maintained in place on the connector; and said member being of an electrically conductive material, with the electrically conductive material and the friction between the dimples and the pins being cooperatively effective for maintaining the pins at substantially the same voltage potential for preventing electrostatic discharge damage through said connector to components of an associated electrical assembly, wherein said member includes:

openings for connector mating hardware.

* * * * *